US005280844A

United States Patent [19]

Kaufman et al.

[11] Patent Number: 5,280,844

[45] Date of Patent: Jan. 25, 1994

[54] BEVERAGE CONTAINERS AND FILLING THEREOF

[75] Inventors: Richard H. Kaufman, Chappaqua; Theodore J. Kovacic, Bedford, both of N.Y.; Hideyoshi Okita, Huntington Beach, Calif.; Martin M. Bestwick, Norwalk; Andrew T. Kostanecki, Darien, both of Conn.; Robert H. Brainard, Danbury; Partick B. Nolan, Norwalk, both of Conn.

[73] Assignee: Kraft General Foods, Inc., Northfield, Ill.

[21] Appl. No.: 958,670

[22] Filed: Oct. 8, 1992

Related U.S. Application Data

[63] Continuation-in-part of Ser. No. 898,114, Jun. 12, 1993, which is a continuation-in-part of Ser. No. 776,444, Oct. 17, 1991, Continuation-in-part of Ser. No. 958,408, Oct. 8, 1992, Continuation-in-part of Ser. No. 958,396, Oct. 8, 1992.

[51] Int. Cl.[5] ..... B65D 39/00

[52] U.S. Cl. ..... 220/710; 206/229; 206/217; 215/229

[58] Field of Search ..... 220/710; 206/229, 217; 215/1 A, 229

[56] References Cited

U.S. PATENT DOCUMENTS

| | | | |
|---|---|---|---|
| 2,516,728 | 7/1950 | Smith | 222/108 |
| 3,303,984 | 2/1967 | Jurena | 229/7 |
| 3,332,567 | 7/1967 | Pugh, Sr. | 215/100 |
| 3,347,401 | 10/1967 | Nataf | 215/1 |
| 3,462,061 | 8/1969 | Shore | 229/7 |
| 3,486,679 | 12/1969 | Pfahler | 229/7 |
| 4,301,926 | 11/1981 | Chung | 206/620 |
| 4,573,631 | 3/1986 | Reeves | 229/7 |
| 4,607,755 | 7/1986 | Andreozzi | 215/1 A |
| 4,669,608 | 6/1987 | Thompson | 206/217 |
| 4,712,702 | 12/1987 | Ayabe et al. | 220/90.2 |
| 4,830,204 | 5/1989 | Lin | 215/1 A |
| 4,982,854 | 1/1991 | Ichimiya | 215/1 A |
| 5,005,717 | 4/1991 | Oilar | 215/13.1 |
| 5,054,631 | 10/1991 | Robbins, III | 215/1 A |
| 5,078,286 | 1/1992 | Hashimoto | 215/1 A |

FOREIGN PATENT DOCUMENTS

| | | | |
|---|---|---|---|
| 2492769 | 4/1982 | France . | |
| 59-172168 | 11/1984 | Japan . | |
| 61-681553 | 6/1986 | Japan . | |
| 63-79337 | 5/1988 | Japan . | |
| 2-117334 | 9/1990 | Japan . | |
| 978901 | 1/1965 | United Kingdom | 229/130.1 |
| WO85/04850 | 3/1985 | World Int. Prop. O. . | |

*Primary Examiner*—Joseph Man-Fu Moy
*Attorney, Agent, or Firm*—Thomas R. Savoie

[57] ABSTRACT

Unitary beverage containers and methods of filling thereof are disclosed where the beverage container includes a main body and a filling conduit extending from the top thereof which is closed off after filling. In embodiments with a separate straw, an attaching mechanism removably attaches the distal end of the flexible straw to the top of main body and closes the aperture in the distal end. The attaching mechanism includes a short hollow bridge extending from the aperture which is broken during removal of the flexible straw to uncover the aperture prior to use. The hollow bridge is connected to a hollow chamber member which is otherwise isolated fluidly from the container volume. A concavity is provided at the top in which a mouthpiece at the distal end of the straw is received. In some preferred embodiments, the filling conduit extends from the top of the main body, and from adjacent the mouthpiece or from the mouthpiece itself. In another embodiment, the filling conduit acts as a beverage conduit and mouthpiece for both filling and ultimate drinking by the consumer. With this latter embodiment, the beverage conduit is inverted into the main body after filling and returned outside of the main body for drinking.

23 Claims, 5 Drawing Sheets

32
26
34
16
20
21
10
12
18
24
22

16
32
34
21
20a
44
10
12
18

32
34
42
36
16
20a
21
20
10
26
22
24
18
45
44
12

FIG. 16
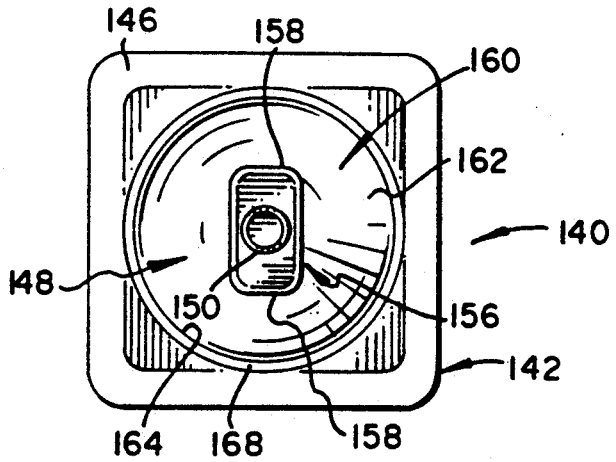
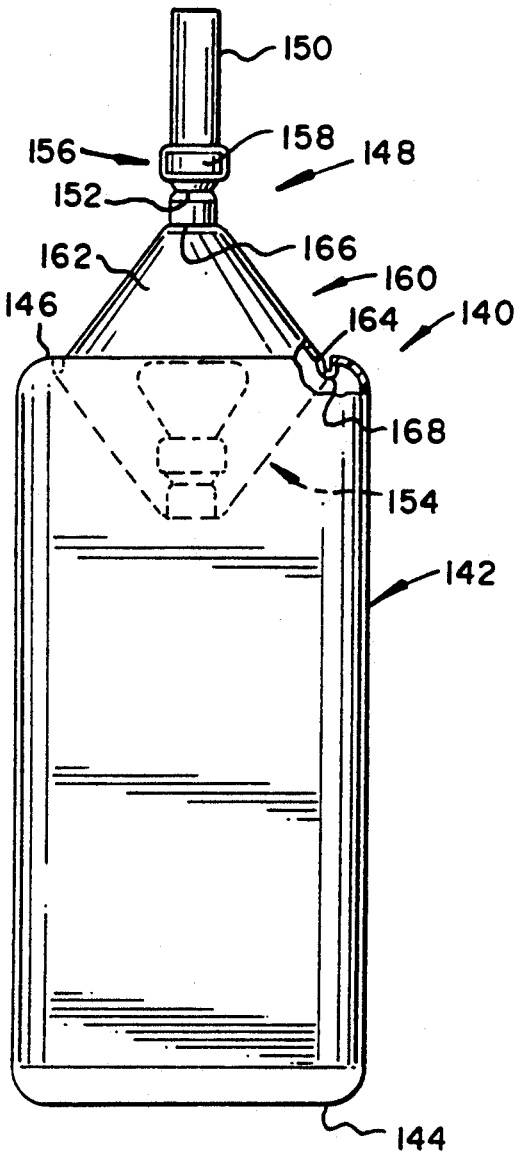
FIG. 14
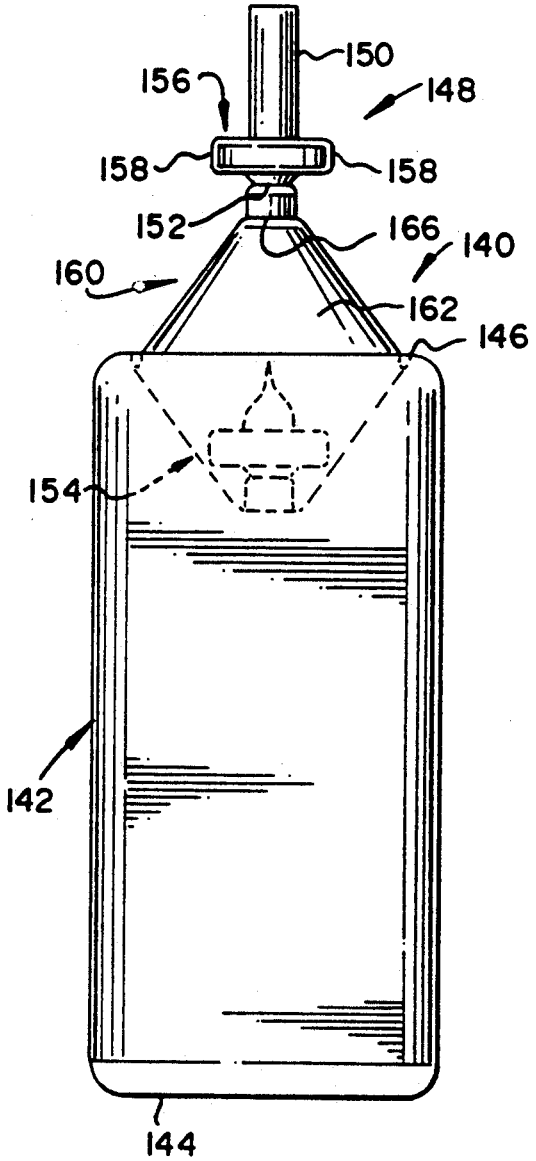
FIG. 15

BEVERAGE CONTAINERS AND FILLING THEREOF

RELATED APPLICATION

This application is a continuation-in-part of U.S. application Ser. No. 07/958,396 filed concurrently herewith, 1992 and U.S. application Ser. No. 07/958,408 filed concurrently herewith, and a 1992 continuation-in-part of U.S. application Ser. No. 07/898,114 filed Jun. 12, 1992, which in turn is a continuation-in-part of U.S. application Ser. No. 07/776,444 filed Oct. 17, 1991, which applications are hereby incorporated by reference.

FIELD OF THE INVENTION

The present invention relates generally to beverage containers, and more particularly to a one-piece or unitary beverage container with an integral straw or beverage conduit and the filling of such a beverage conduit.

BACKGROUND OF THE INVENTION

Many different beverages are provided in various containers. Of particular use by small children are small beverage containers which are accessed by a straw. Typically, the straw is removably attached to the outside of the container and is separately wrapped. Thus, the straw can be lost making the beverage hard to consume. In addition, the loose straw and wrapper for the straw are potential problems with small children who might accidentally try to swallow them. These loose items are also a trash nuisance as they tend to be dropped. Further, many of these small beverage containers are made from multi-ply laminates which include paper, foil and plastic and are therefore not easily recyclable.

A beverage container made of a synthetic resin and having a sipping tube or straw connected to the container bottom is disclosed in U.S. Pat. No. 4,982,854 (Ichimiya). A middle portion of the sipping tube is provided with a flexional bellows and the sipping tube is fitted into a longitudinal groove formed on the container body. Filling is accomplished by an inlet provided in a concave portion of the bottom which inlet is subsequently covered by an adhesive film. Another plastic beverage container including an attached straw is disclosed in U.S. Pat. No. 5,078,286 (Hashimoto). With this beverage container, excess filling tube material is removed after filling.

Other patents have also disclosed various integral sipping tubes or straws. Among these are the following U.S. Pat. No 4,607,755 (Andreozzi), U.S. Pat. No. 4,573,631 (Reeves), U.S. Pat. No. 4,830,204 (Lin), and U.S. Pat. No. 5,054,631 (Robbins). Other containers of general interest including various straw mounting means are shown in the following U.S. Patents: U.S. Pat. No. 5,005,717 (Oilar), U.S. Pat. No. 3,332,567 (Pugh, Sr.), U.S. Pat. No. 4,669,608 (Thompson), and U.S. Pat. No. 4,712,702 (Ayabe et al.).

SUMMARY OF THE INVENTION

In accordance with the present invention, a unitary beverage container is provided which includes a main body defining a container volume in which a beverage is contained. The main body includes a top and a bottom. A flexible straw is also provided having a proximal end which is fluidly connected with the container volume adjacent the bottom of the main body and a distal end having an aperture therein which is located adjacent the top of the main body. An attaching means removably attaches the distal end of the flexible straw to the top of the main body and closes the aperture of the distal end of the flexible straw. The attaching means includes a hollow chamber member attached to the top and a short hollow bridge extending from the distal end of the flexible straw and about the aperture to the hollow chamber member. The hollow bridge is broken during removal of the distal end of the flexible straw from the top and thereby the aperture of the flexible straw is uncovered prior to use. A filling conduit is further provided which extends from the main body and which is closed off after filling of the main body with the beverage.

In a preferred embodiment of the invention, the distal end of the flexible straw includes a mouthpiece having a lever portion. Preferably, the lever portion is a top wing and an opposed bottom wing, which wings extend vertically from a remaining portion of the mouthpiece. The top of the main body then includes a concavity in which the bottom wing is received and a top portion adjacent the concavity from which the filling conduit extends. The filling conduit is preferably closed of by a pinch thereof located at a height above the top substantially the same as that of the top wing. In one preferred configuration, the hollow chamber member includes a solid connection to the top of the container in the concavity such that the hollow chamber member is in fluid communication with the container volume only through the flexible straw. Alternately, the hollow chamber member includes a solid connection to the top portion and to the filling conduit such that the hollow chamber member is in fluid communication with the container volume only through the flexible straw.

In a second preferred embodiment, the distal end of the flexible straw includes a mouthpiece having a lever portion. The lever portion is preferably a top wing and an opposed bottom wing, with the wings extending vertically from a remaining portion of the mouthpiece. The top of the main body then includes a concavity in which the bottom wing is received, and the filling conduit includes the mouthpiece and a spout which extends upwardly from the top wing. After filling, the filling conduit is pinched off at an intersection of the top wing and the spout. Preferably, the filling conduit further includes a passage through the concavity between the mouthpiece and the main body whereby after filling the filling conduit is pinched off at the passage.

In a third embodiment of the invention, a different unitary beverage container includes a similar main body and a beverage conduit through which the main body is filled and emptied of the beverage (instead of a straw and separate filling conduit as with the previous embodiments). The beverage conduit extends outwardly of the main body from the top of the main body during filling and is subsequently closed. This beverage conduit includes a breakable connection provided below the position where the beverage conduit is closed which is broken when it is desired to consume the beverage in the main body. In addition, the beverage conduit also includes an inversion facilitating means for accommodating an inversion of a portion of the beverage conduit (remaining after the beverage conduit is closed) to a position where all of the portion of the beverage conduit is located inside of the main body and for accommodating a return of the remaining portion of the beverage conduit outward of the main body.

Preferably in this third embodiment, the top is peripherally flat with no central protrusions and the inversion facilitating means of the beverage conduit includes a tapered sleeve having a proximal end adjacent the flat top and a distal end which is smaller in diameter than the proximal end. In addition, the beverage conduit further includes a tube extending from the distal end of the tapered sleeve. This tapered sleeve is preferably a frustoconical member, and the inversion facilitating means then further includes a connecting ring between the flat top and the proximal end of the frustoconical member which is semicircular shaped in radial cross section. With this configuration, the breakable connection is located adjacent the distal end of the frustoconical member and includes a weakened portion of the tube.

In a manner similar to other embodiments, the tube of the third embodiment preferably includes a lever portion extending perpendicular to a longitudinal axis of the tube. This lever portion is located adjacent the weakened portion such that the lever portion is easily twisted by the user to break the weakened portion. Preferably, the lever portion is a pair of wings extending in opposite directions.

In a method for filling a beverage container according to certain embodiments of the present invention, the beverage container is first formed with a main body defining a container volume. This main body includes a top, a bottom, and a flexible straw having a proximal end which is fluidly connected with the container volume adjacent the bottom and a distal end having an aperture therein which is located adjacent the top. An attaching means is also provided for removably attaching the distal end of the flexible straw to the top of the main body and for closing the aperture of the distal end of the flexible straw. In particular, the attaching means includes a hollow chamber member attached to the top and a short hollow bridge extending from the distal end of the flexible straw and about the aperture to the hollow chamber member whereby the hollow bridge is broken during removal of the distal end of the flexible straw from the top and thereby the aperture of the flexible straw is uncovered prior to use. A filling conduit which extends from the main body is further provided. Next, the main body is filled with a beverage through the filling conduit and then the filling conduit is closed off.

In a preferred embodiment of the method, the forming step includes the step of forming (a) the distal end of the flexible straw as a mouthpiece having a top wing and an opposed bottom wing which wings extend vertically from a remaining portion of the mouthpiece, and (b) the top of the main body with a concavity in which the bottom wing is received, with a top portion adjacent the concavity, and with the filling conduit extending from the top portion. Then, the closing step includes the step of closing the filling conduit by pinching off all of the filling conduit extending beyond the top wing.

In a another embodiment of the method, the forming step includes the step of forming (a) the distal end of the flexible straw as a mouthpiece having a top wing and an opposed bottom wing which wings extend vertically from a remaining portion of the mouthpiece, and (b) the top of the main body with a concavity in which the bottom wing is received and with the filling conduit extending as a spout from the top wing. Then, the closing step includes the step of closing the filling conduit by pinching off the filling conduit at the intersection of the spout and the top wing. Preferably, the forming step further includes the step of forming a passage through the concavity between the mouthpiece and the main body and the closing step further includes the step of pinching off the passage.

In yet another and last method for filling a beverage container according to the present invention, a beverage container is formed as discussed above with a main body defining a container volume and including a top and a bottom. In addition, a beverage conduit through which the main body is filled and emptied of the beverage is provided with the beverage conduit extending outwardly of the main body from the top of the main body. A breakable connection is then provided on the beverage conduit which is broken when it is desired to consume the beverage in the main body through the beverage conduit. An inversion facilitating means is further provided for accommodating an inversion of a portion of the beverage conduit (remaining after the beverage conduit is closed) to a position where all of the remaining portion of the beverage conduit is located inside of the main body and for accommodating a return of the portion of the beverage conduit outward of the main body. The main body is then filled with a beverage through the filling conduit and the filling conduit above the breakable connection is closed off to leave the portion of the beverage conduit. Finally, the portion of the beverage conduit inside of the main body is inverted for packaging and shipping.

In accordance with a preferred embodiment of this last method, the forming step includes the step of forming (a) the top peripherally flat, (b) the inversion facilitating means with a tapered sleeve having a proximal end adjacent the flat top and a distal end which is smaller in diameter than the proximal end, and (c) the beverage conduit as a tube extending from the distal end of the tapered sleeve. More preferably, the forming step further includes the step of forming the tapered sleeve as a frustoconical member, and the inversion facilitating means as a connecting ring between the flat top and the proximal end of the frustoconical member which is semicircular shaped in radial cross section. Still more preferably, the forming step includes the step of forming the tube with a lever portion extending perpendicular to a longitudinal axis of the tube which is located adjacent the breakable connection such that the lever portion is easily twisted by the user to break the breakable connection.

It is an object of the present invention to provide for filling of a one-piece beverage container which can be filled in an upright orientation.

It is also an object of the present invention to provide a one-piece beverage container which is easy to make, fill, and use.

It is a further object of the present invention to provide a one-piece beverage container which stands up readily and which is easy to package together with other such beverage containers after filling.

It is a still further object of the present invention to provide a beverage container which does not spill easily during filling.

Another object of the present invention is to provide a beverage bottle and associated parts which are strong and which will not easily develop leaks after filling.

Other features and advantages of the present invention are stated in or apparent from a detailed description of presently preferred embodiments of the invention found hereinbelow.

BRIEF DESCRIPTION OF THE DRAWINGS

FIG. 5' is an enlarged sectional view of a portion of the bridge depicted in FIG. 5 indicated by the dashed circle 5'.

FIG. 14 is a front elevation view of a fourth alternative beverage container and filling conduit therefor.

FIG. 15 is a right side elevation view of the beverage container and filling conduit depicted in FIG. 14.

FIG. 16 is a top plan view of the beverage container and filling conduit depicted in FIG. 14.

DETAILED DESCRIPTION OF THE PREFERRED EMBODIMENTS

Figure 3:
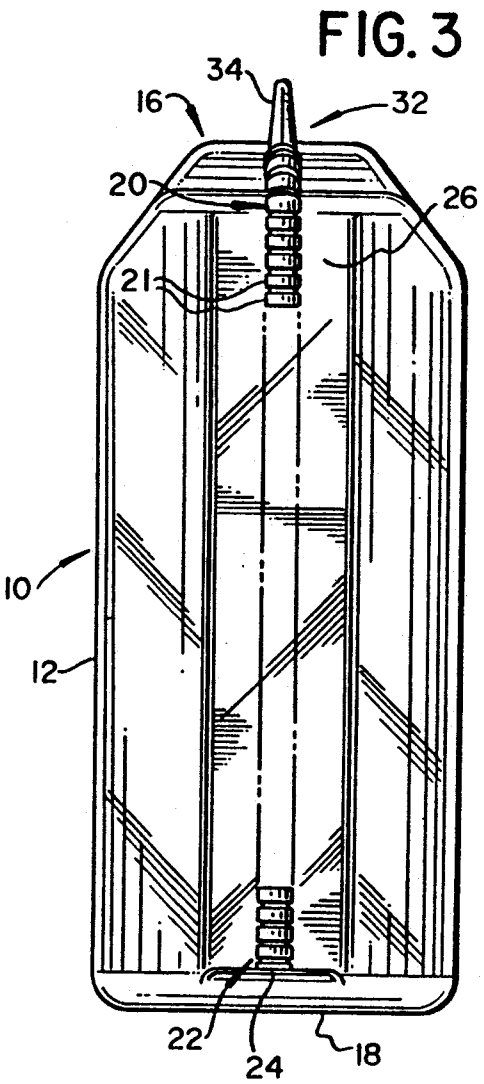
FIG. 3 is an elevation view of the filled beverage container depicted in FIG. 1 which has been rotated 45°.
Figure 2:
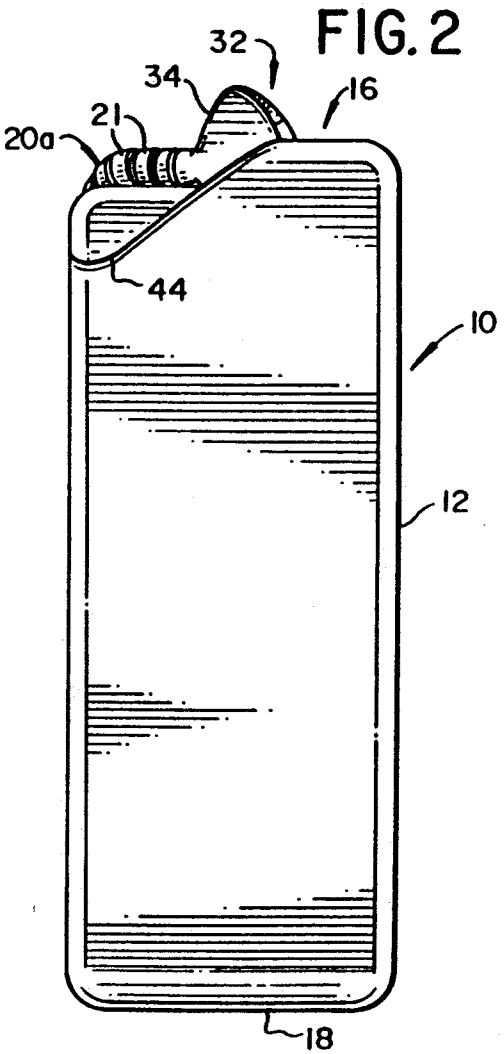
FIG. 2 is a rear elevation view of the filled beverage container depicted in FIG. 1.
Figure 1:
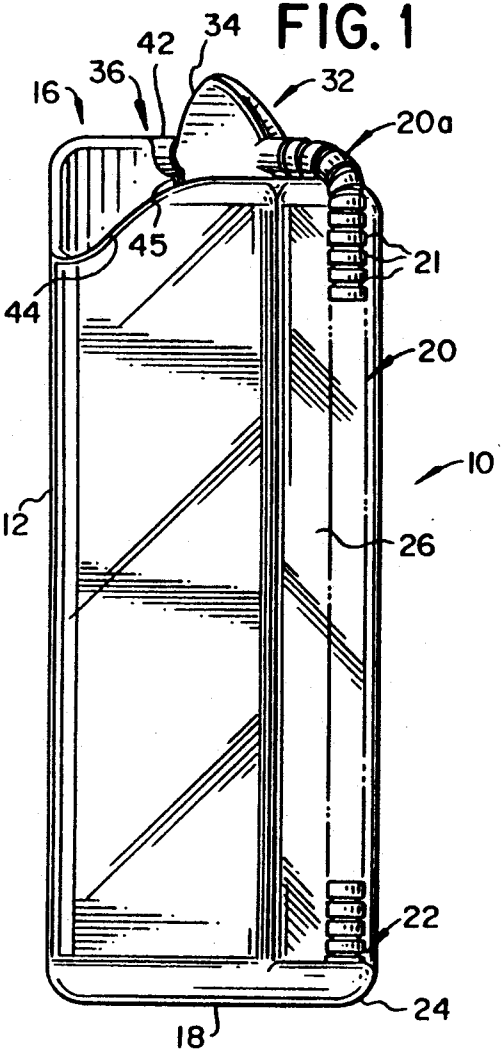
FIG. 1 is a front elevation view of a filled beverage container structure suitable for use in present invention.

With reference now to the drawings in which like numeral represent like elements throughout the views, a beverage container 10 is depicted in FIGS. 1-4. Beverage container 10 is designed to be blow molded from a synthetic resin or plastic such as low density or high density polyethylene, as a unitary or one-piece container formed in a single operation. Beverage container 10 includes a main body 12 which is rectangularly shaped with rounded corners in plan view and which defines a container volume 14 in which a beverage is contained. Typically, such beverages are fruit juices, flavored drinks or the like. With such beverages, the material of beverage container 10 is usually translucent so that the liquid level can be seen, and the material is colored the same or similar to the color of the beverage contained. In addition, suitable indicia or the like can be provided on the walls of main body 12 as part of the blow molding process if desired. Main body 12 has a top 16 particularly shaped as described subsequently and a bottom 18 which is peripherally flat and somewhat recessed inside of the periphery so that beverage container 10 stands upright easily in normal use.

In order to access the beverage in volume 14 of main body 12, an integral sipping tube or straw 20 is provided which is formed to be easily bendable. Straw 20 has a proximal end 22 which is integrally formed at a bottom corner 24 of main body 12. Straw 20 extends upwardly along a bevel surface 26 of main body 12 provided above corner 24 and between the two adjacent sides. As will be appreciated from FIG. 8, bevel surface 26 is sized so that straw 20 stays inside of the silhouette of main body 12 when viewed from the bottom.

Straw 20 is removably attached to bevel surface 26 by an attaching means, which may be a very thin connecting pieces forming an essentially continuous strip between the outer portions of straw 20 and bevel surface 26. Preferably, this strip is formed in the blow molding process and is so thin as to be easily broken by the user when it is desired to detach all but proximal end 22 of straw 20 from main body 12.

Figure 5:
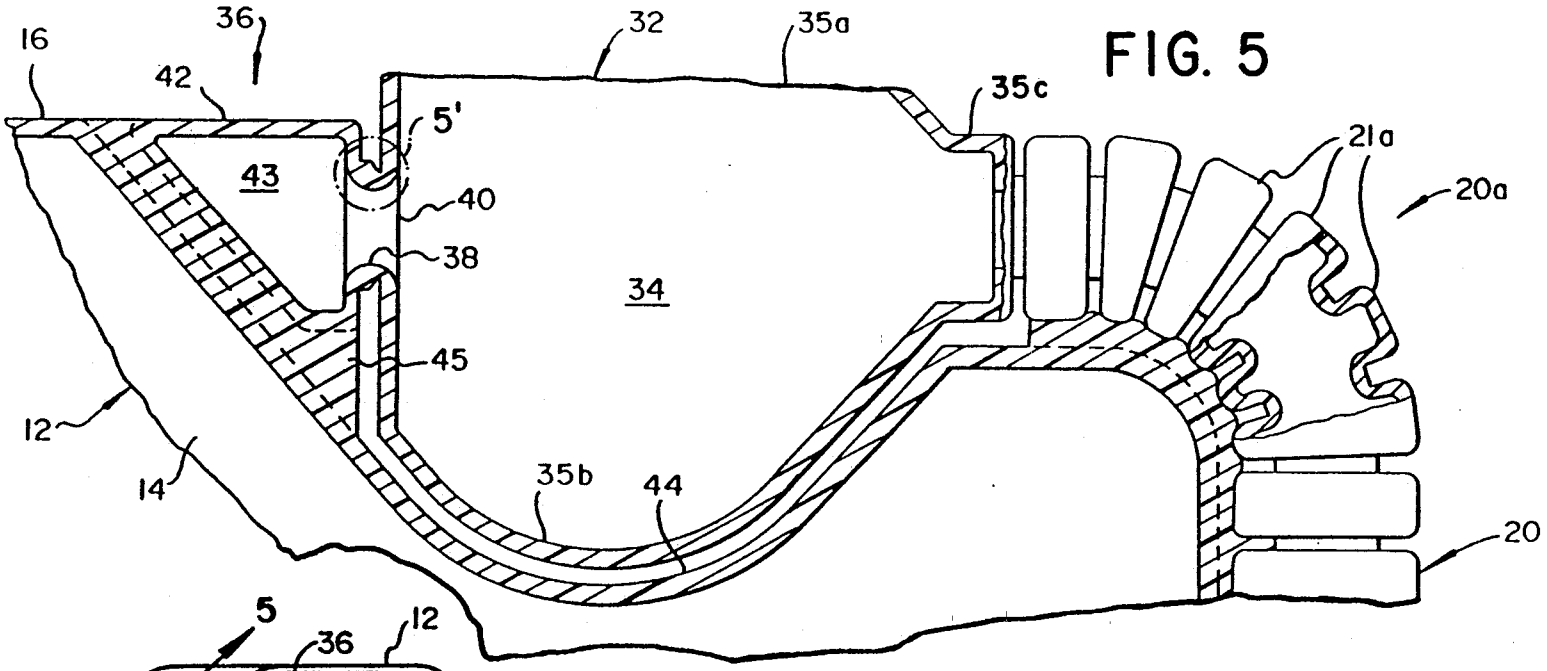
FIG. 5 is a cross-sectional elevation view of the top of the beverage container taken along the line 5—5 in FIG. 4.
Figure 5:
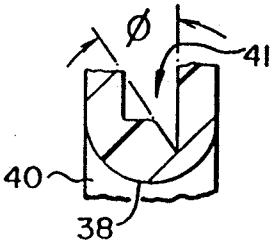

Straw 20 also includes a distal end 32 which is shaped into a mouthpiece 34. Mouthpiece 34 is hollow and planar shaped as shown in FIG. 5 and is comprised of an upper wing 35*a* (only part of which is shown), a lower wing 35*b*, and a remaining (central) portion 35*c*. This configuration is designed to be easily retained in the mouth of a user, particularly young children. It will be appreciated that mouthpiece 34 is provided with wings 35*a* and 35*b* so that wings 35*a* and 35*b* can serve as a lever or twisting handle. By use of such a lever, mouthpiece 34 is easily detached from an attaching means 36 by which mouthpiece 34 is attached to top 16 of main body 12. It will be appreciated that mouthpiece 34 has been depicted in a preferred shape, but that mouthpiece 34 could be provided in a variety of shapes consistent with its use as a lever as indicated in the copending applications mentioned above. Mouthpiece 34 could also be made smaller so long as mouthpiece 34 is provided with sufficient surface area to serve as a lever, and particularly the necessary finger gripping surface area for a thumb and forefinger.

Mouthpiece 34 with wings 35*a* and 35*b* is depicted as hollow and planar in a vertical plane, which is easy to provide as mouthpiece 34 (and the remainder of beverage container 10) is blow molded. This hollowness results in a small amount of air which is drawn into the mouth each time that the user sucks on straw 20. Thus, if desired, mouthpiece 34 could be made less hollow or even solid with just a tubular conduit therethrough. However, a hollow mouthpiece 34 is nonetheless preferred as such a configuration is more comfortable in the mouth. In addition, by making mouthpiece 34 hollow, this hollowness and overall planar shape also contribute to the stiffness of mouthpiece 34 necessary for wings 35*a* and 35*b* of mouthpiece 34 to serve as a lever portion thereof. Further, the existence of the hollow volume will reduce leakage from the mouthpiece during opening of the container and will reduce spillage from the opened container in the event the container is knocked over.

As shown best in FIG. 5, attaching means 36 is essentially a short hollow bridge 38 extending from an aperture 40 provided in mouthpiece 34 to a connecting piece 42. The configuration of hollow bridge 38 is shown in greater detail in FIG. 5'. Thus, it will be appreciated that hollow bridge 38 is formed with a V-shaped notch 41 circumferentially thereabout which is radially directed toward a central longitudinal axis of hollow bridge 38 (and mouthpiece 34). Preferably, notch 41 is formed by an angle $\phi$ from vertical of about 30°. V-shaped notch 41 provides a localized weakening of hollow bridge 38 which is easily broken by twisting of mouthpiece 34. This V-shaped notch 41 or other thinned portion is easily formed in the molding process as the material flows about the mold piece.

The size of aperture 40 is not critical with respect to the sucking of the beverage from main body, although it obviously must be sufficient for a ready passage of a sufficient amount of the beverage when mouthpiece 34 is sucked on. However, the size of aperture 40 is important insofar as the larger the size, the greater the force which will be required to severe hollow bridge 38. Thus, a compromise is necessary for these competing objectives, and in beverage container 10 aperture 40 is preferably about 3.2 mm.

Connecting piece 42 of attaching means 36 is comprised of a hollow chamber 43 securely attached to a concavity or recess 44 provided in top 16 of main body 12 by a solid connection in the form of a connecting wall 45. Hollow chamber 43 must be hollow in order to form aperture 40 in mouthpiece 34 during the blow molding process as beverage container 10 is formed. In particular, during the blow molding process, aperture 40 is and must be formed as air passes through aperture 40 in order to subsequently form hollow chamber 43 in connecting piece 42. Hollow chamber 43 is, preferably, otherwise not in fluid communication with main body 12.

It is preferable for hollow chamber 43 not to be in fluid communication with main body 12 except through straw 20. One such reason is that if hollow chamber 43 was in fluid communication with main body 12, after mouthpiece 34 was removed, hollow chamber 43 would be a source of leakage from main chamber 12 in the event the container is knocked over or excessively squeezed after opening.

Figure 4:
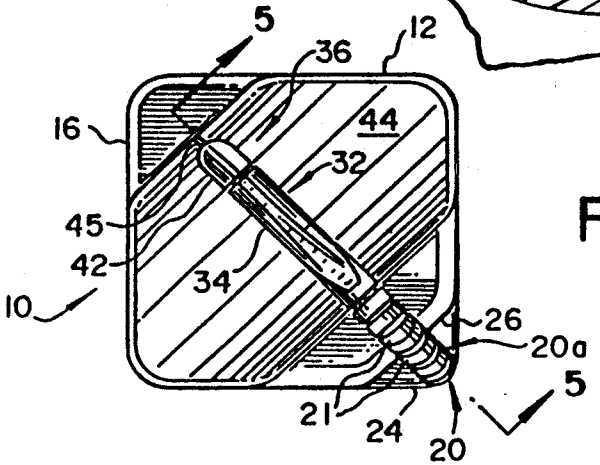
FIG. 4 is a top plan view of the beverage container depicted in FIG. 1.

As best shown in FIG. 4, concavity 44 provided in top 16 of main body 12 extends along the entire distance of top 16, and the shape of concavity 44 matches the profile of wing 35*b* of mouthpiece 34. It should be appreciated that top 16 of main body 12 is reduced in height at the side adjacent to straw 20 so that the height of top 16 at this position and the height of straw 20 (together with the minimal height of the connecting pieces of strip 30) together equal the height of the remainder of top 16. Thus, straw 20 is also contained in the profile of top 16 as shown in FIG. 3.

As mentioned above, mouthpiece 34 is easily detached from connection piece 42 by breaking bridge 38 at notch 41. This is easily done by twisting mouthpiece 34 about its longitudinal axis (which is shared with the adjacent portion of straw 20), typically by placing a thumb on one side of wing 35*a* and a forefinger on an opposite side of wing 35*b*. Twisting by applying opposite forces to wings 35*a* and 35*b* causes bridge 38 to nonelasticly deform and break at notch 41 so that mouthpiece 34 can be lifted out of concavity 44. At the same time that mouthpiece 34 is lifted, adjacent connecting portions of the attaching strip are easily severed. The shape, size and orientation of the wings (or other lever portion), as well as the number of wings may be varied.

Figure 11:
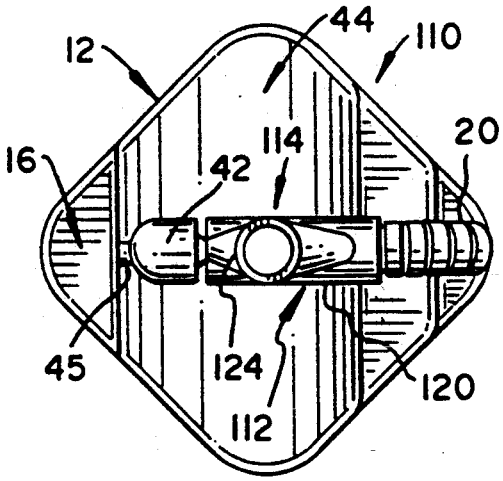
FIG. 11 is a top plan view of the beverage container and filling conduit depicted in FIG. 10.
Figure 12:
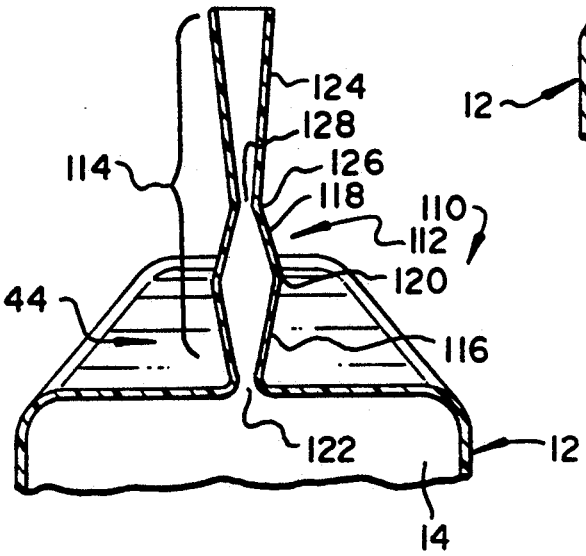
FIG. 12 is cross-sectional elevation view of the beverage container and filling conduit depicted in FIG. 19 taken along the line 12—12.

Straw 20, as shown, is comprised of a plurality of interconnected bellows-like segments 21. Segments 21 have been designed to allow straw 20 to bend easily and without developing leaks. As shown in the drawings, segments 21*a* may possess a generally triangular or wedge shaped side profile (or lateral and radial cross-sectional profile as shown in the broken away portion of FIG. 11) at curved straw portion 20*a* where straw 20 forms the approximately 90° bend at the upper corner of main body 12.

In use, it will be initially appreciated that beverage container 10 is filled and sold to the consumer or user with a protective wrapping material (shrink wrap, plastic overlay, or the like) thereabout as well known by those of ordinary skill in the art. If desired, a number of beverage containers 10, such as six, can be bound together as a pack by the wrapping material. A cardboard sleeve may be positioned around such a pack inside of the wrapping material.

After removal from the wrapping material, the user simply twists mouthpiece 34. This is easily done due to the combined features of the flat shape of mouthpiece 34 with wings 35*a* and 35*b*, the concavity 44 provided, and the fact that wing 35*a* of mouthpiece 34 extends beyond straw 20. This twisting of mouthpiece 34 easily causes notch 41 of bridge 38 to break or shear apart. When this occurs, aperture 40 of mouthpiece 34 is exposed, and mouthpiece 34 can be lifted from concavity 44. As mouthpiece 34 is lifted from concavity 44, the connecting portions of strip 30 attaching the adjacent segment of straw 20 to top 16 are also easily broken or severed. Similarly, by continued pulling on straw 20, the remaining connecting portions of strip 30 along bevel surface 26 are severed so that straw 20 can be moved by the user to any convenient position. The user then simply sucks on mouthpiece 34 to drink the beverage in volume 14 of main body 12.

It should be appreciated that mouthpiece such as shown at 34 is easily retained in the mouth of the user due to its flat shape, which is especially advantageous for young children. In addition, by making straw 20 flexible, the user can play with the straw which is also an attraction for young children. Further, it should be appreciated that there are no loose parts of beverage container 10 which could become lost or accidentally ingested or swallowed.

Figure 6:
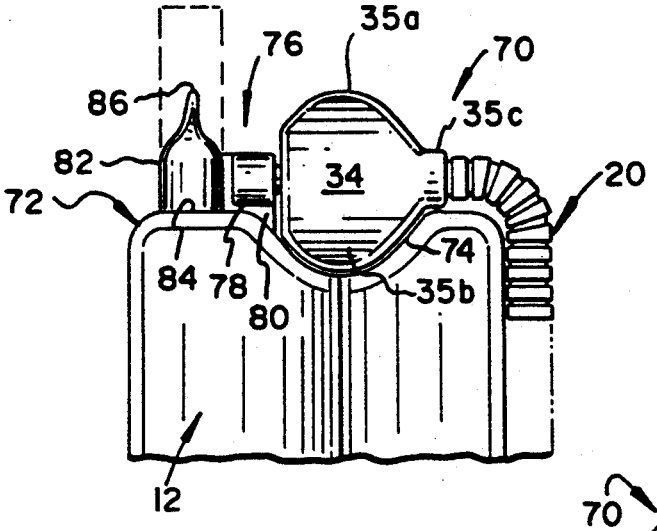
FIG. 6 is an elevation view of a top part of a beverage container and filling conduit therefor in accordance with this invention.
Figure 7:
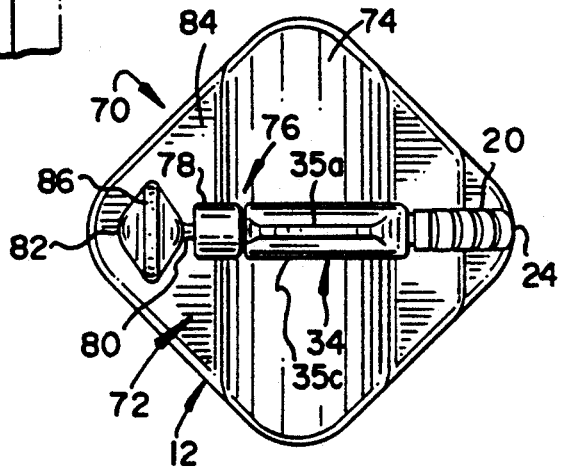
FIG. 7 is a top plan view of the beverage container and filling conduit depicted in FIG. 6.

According to the filling methods depicted in our prior copending applications the beverage container is reversed (turned upside down) to be filled. In this upside down position, the beverage container may be hard to support, due to the presence of structural elements such as the top wing 352. In order to avoid this problem, a beverage container 70 is depicted in FIGS. 6–7 which is filled from the top and hence does not require reversing. As beverage container 70 is otherwise similar to beverage container 10, the remainder of beverage container 70 is not depicted and the same reference numerals are used with certain elements of beverage container 70 as were used with the same elements of beverage container 10.

As shown, beverage container 70 includes a top 72 which is basically similar to top 16. However, it will be appreciated that top 72 has the same height on either side of concavity 74. With this construction, attaching means 76 is also somewhat different from attaching means 36. Thus, attaching means 76 includes a hollow chamber member 78 (i.e., a connecting piece with a hollow chamber therein) located above top 72 and connected thereto by a connecting wall 80.

The filling of beverage container 70 is accomplished with a filling conduit or tube 82. Filling tube 82 is located on a top portion 84 on the opposite corner from straw 20 and is also attached to connecting wall 80 as shown. It will be appreciated that filling tube 82 is initially provided with a height as shown by the dashed line. However, after filling, filling tube 82 is simply closed off and cut as by a pinch 86 provided at the level of the upper part of top wing 35*a* as shown.

With beverage container 70, it will thus be appreciated that no reversing is required for filling, and that a stable and flat bottom (which is somewhat concave for stability as known in the art) is provided. However, it will also be appreciated that the appearance of the upper portion of beverage container 70 is complicated and not the simple contour of beverage container 10 which is considered more preferable.

Figure 8:
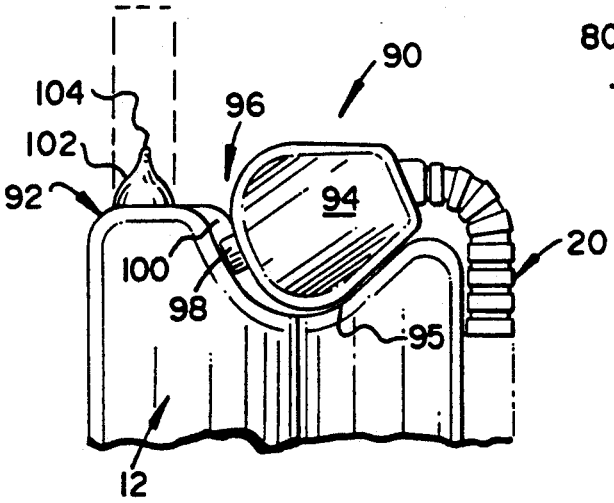
FIG. 8 is an elevation view of a top part of a second beverage container and filling conduit therefor in accordance with this invention.
Figure 9:
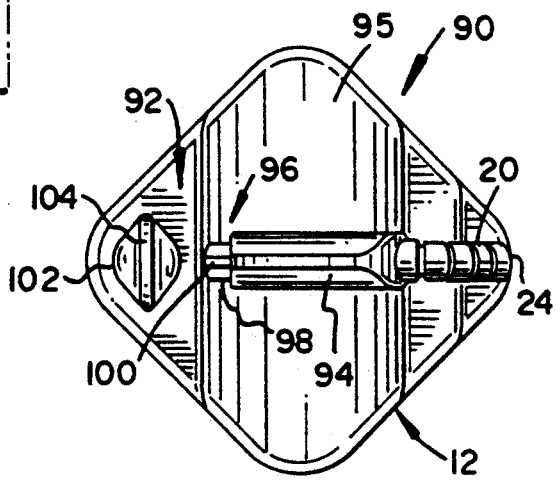
FIG. 9 is a top plan view of the beverage container and filling conduit depicted in FIG. 8.
Figure 10:
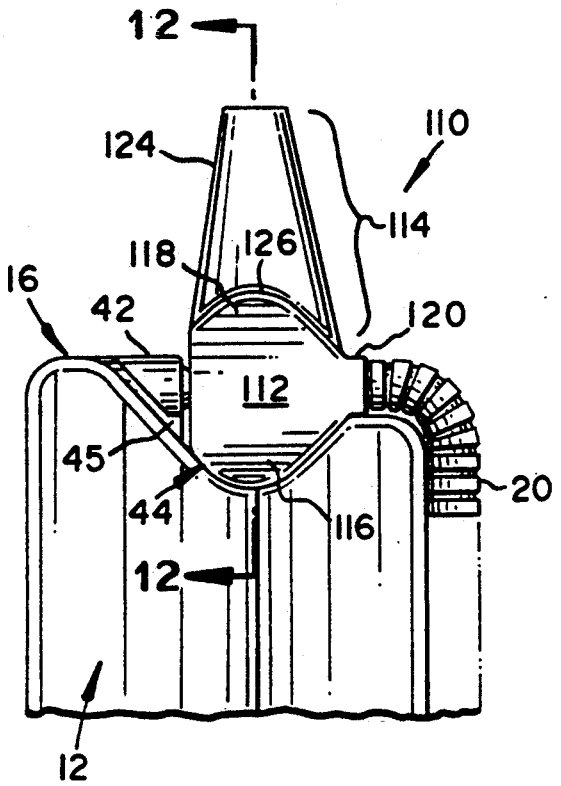
FIG. 10 is an elevation view of a top part of a third beverage container and filling conduit therefor in accordance with this invention.

In order to reduce the appearance problem noted above, a second embodiment of a beverage container 90 is depicted in FIGS. 8–9. Beverage container 90 is broadly similar to beverage container 70 and is also filled from the top so that it does not require reversing in order to be filled. As beverage container 90 is otherwise similar to beverage container 10, the remainder of beverage container 90 is not depicted and the same reference numerals are used with certain elements of beverage container 90 as were used with the same elements of beverage container 10.

As shown, beverage container 90 includes a top 92 which is basically similar to top 16. However, it will be appreciated that mouthpiece 94 is different from mouthpiece 34 and is positioned differently in concavity 95. In particular, mouthpiece 94 (and the longitudinal axis thereof) is angled into concavity 95 so that an attaching means 96 including hollow chamber member 98 and a solid connecting wall 100 are located in concavity 95. This construction gives a lower profile to mouthpiece 94 compared to mouthpiece 34.

Beverage container 90 is provided with a filling conduit or tube 102 which is located in the same position as that for beverage container 70. However, after filling, filling tube 102 is easily cut off and sealed much lower and closer to top 92 as shown. As with beverage container 70, filling tube 102 is preferably closed by a heat sealing pinch 104 located at the same height as the upper part of mouthpiece 94. With pinch 104 of filling tube 102 much lower than that for beverage container 70, the appearance of the top of beverage container 90 is lower, smoother, and less complicated (and thus better in that sense) than beverage container 70. It will also be noted that while filling tube 102 is not reinforced with a portion of connecting wall 100 in the same manner as filling tube 82 of beverage container 70, this is not important as filling tube 102 is much shorter than filling tube 82 and thus does not require such a reinforcement.

In order to achieve the same appearance as beverage container 10 while still retaining the advantages of top filling, a third embodiment of a beverage container 110 is depicted in FIGS. 10–13. As beverage container 110 is otherwise similar to beverage container 10, the remainder of beverage container 110 is not depicted and the same reference numerals are used with certain elements of beverage container 90 as were used with the same elements of beverage container 10.

Beverage container 110 is formed in a manner similar to beverage container 10 but with a particular mouthpiece 112 which actually forms part of a filling conduit 114. Thus, in this embodiment, filling conduit 114 includes mouthpiece 112 which, as with previous embodiments, has a bottom wing 116, a top wing 118 (or rather what will become top wing 118), and a remaining portion 120. In addition, filling conduit includes a passage 122 extending from bottom wing 116 to container volume 14 of main body 12 and a spout 124 which extends upwards from an intersection 126 with top wing 118. As shown, there is a passage 128 between spout 124 and top wing 118.

Figure 13:
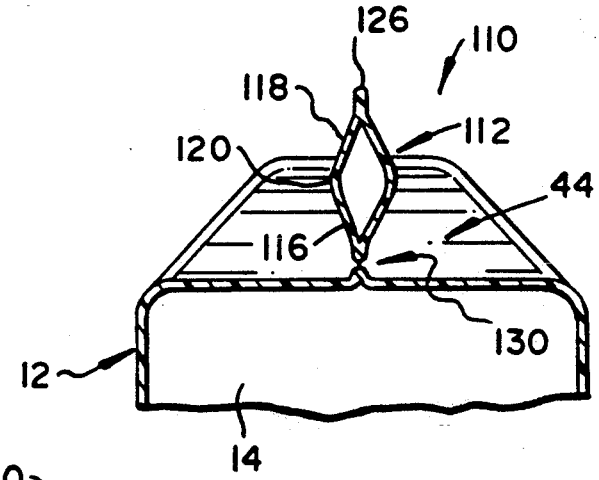
FIG. 13 is cross-sectional elevation view of the beverage container and filling conduit depicted in FIG. 12 after finishing.

To fill beverage container 110, the beverage is simply fed into spout 124 where the beverage then directly flows down into container volume 14. After container volume 14 is thus filled, spout 124 is pinched off or otherwise separated from top wing 118 at intersection 126 so that passage 128 is sealed as shown in FIG. 13. In addition, passage 122 is also preferably closed as by ultrasonic welding to form a small connecting wall 130 as also shown in FIG. 13. Thus, beverage container 110 is finally formed with essentially an identical overall shape and construction as beverage container 10, but without the need for bottom filling.

Depicted in FIGS. 14–16 is an alternative embodiment for a beverage container 140 which is also top filled. Beverage container 140 is broadly similar with regard to a filling design feature shown and described in our copending Parent application Ser. No. 07/898,114 as a bottom filling feature and in the aforementioned U.S. patent to Hashimoto, but there are a number of differences in use of these similar design features. Initially, it will be appreciated that beverage container 140 includes a rectangular blow-molded main body 142 defining a container volume in which a beverage is contained. Main body 142 has a flat or slightly recessed bottom 144 and a flat top 146. When first formed, beverage container 140 includes a beverage conduit 148 extending from top 146 through which main body 142 is filled with the beverage. After filling, beverage conduit 148 is closed and inverted. It will be appreciated that main body 142 is eventually emptied through beverage conduit 148 as well after beverage conduit is returned to the outwardly extending (i.e., before inversion) position.

Beverage conduit 148 includes a tube 150 and a breakable connection 152 located below the position where tube 150 is closed off. Typically, tube 150 is closed off by a heat pinching, crimping, or other suitable sealing operation which cuts off a portion of tube 150 leaving a remaining portion 154 of beverage conduit 148 as shown in dashed lines (and after inversion). Thereafter, the remaining portions of beverage conduit 148 are pushed or slammed by a plunger or the like so as to be partially inverted and thus located in the interior of main body 142, as shown best in FIG. 14. This is done while beverage conduit 148 is warm (at least because the beverage is hot) so that there is not much resistance to this movement. While there is some increase in pressure in main body 142 caused by this inversion, this increase is more or less matched by a decrease in pressure as the hot beverage cools. Preferably, breakable connection 152 is simply a weakened portion of tube 150 similar to other weakened connections previously described or known in the art. In addition, as with other embodiments of the beverage container discussed above, tube 150 includes a lever portion 156 extending perpendicular to a longitudinal axis of tube 150 to help in breaking breakable connection 152 with a twisting of lever portion 156. Lever portion 156 is preferably a pair of short wings 158 formed in tube 150 above breakable connection 152.

Beverage conduit 148 also includes an inversion facilitating means 160 for accommodating an inversion of remaining portion 154 of beverage conduit 148 after filling of main body 142 and closing of tube 150. As shown in dashed lines, remaining portion 154 is inverted into main body 142 to a position where all of remaining portion 154 is contained in main body 142 (i.e., below top 146). In addition, it will also be appreciated that inversion facilitating means 160 also accommodates a return of remaining portion 154 to the position shown in solid lines by squeezing of main body 142 (and hence reversing the initial inversion).

Inversion facilitating means 160 includes a tapered sleeve 162 in the form of a frustoconical member having a relatively wide proximal end 164 adjacent top 146 and a narrower distal end 166 from which tube 150 extends. Inversion facilitating means 160 also includes a connecting ring 168 which connects top 146 and proximal end 164 of tapered sleeve 162. Connecting ring 168 is semicircular shaped in radial cross section.

As indicated above, after filling, tube 150 is pinched off or otherwise sealed shut and remaining portion 154 of beverage conduit 148 is inverted in main body 142. In this form, beverage conduit is thus suitable for packaging and Shipping as a basic rectangular container. Such a shape, with no protrusions, is especially advantageous for packaging and shipping. Thereafter, when the consumer wishes to consume the beverage in beverage container 140, beverage container 140 is squeezed sufficiently to pop remaining portion 154 of beverage conduit 148 back to the position where it extends above top 146. If necessary or desired, the consumer could also assist the popping of remaining portion 154 by pulling on the pinched off portion of tube 150. In this position, wings 158 are easily grasped and twisted relative to main body 142 to break breakable connection 152. The consumer then drinks the beverage through tube 150. While this embodiment is advantageous for a number of reasons, it will be appreciated that one drawback over other embodiments is that there is a throwaway piece (wings 158 and the portion of tube 150 thereabove) which must be disposed of by the consumer.

While the present invention has been described with respect to an exemplary embodiment thereof, it will be understood by those of ordinary skill in the art that variations and modifications can be effected within the scope and spirit of the invention.

What is claimed is:

1. A unitary beverage container comprising:

a main body defining a container volume in which a beverage is contained, said main body including a top and a bottom;

a flexible straw having a proximal end which is fluidly connected with the container volume adjacent said bottom of said main body and a distal end having an aperture therein which is located adjacent said top of said main body;

an attaching means for removably attaching said distal end of said flexible straw to said top of said main body and for closing said aperture of said distal end of said flexible straw, said attaching means including a hollow chamber member attached to said top and a short hollow bridge extending from said distal end of said flexible straw and about said aperture to said hollow chamber member, whereby said hollow bridge is broken during removal of said distal end of said flexible straw from said top and thereby said aperture of said flexible straw is uncovered prior to use; and a filling conduit which extends from the top of said main body and which is closed off after filling of said main body with the beverage.

2. A unitary beverage container as claimed in claim 1 wherein said distal end of said flexible straw includes a mouthpiece having a lever portion such that said lever portion assists a user in a twisting of said mouthpiece to break said hollow bridge; wherein said top of said main body includes a concavity adjacent said mouthpiece and a top portion adjacent said concavity; and wherein said filling conduit extends from said top portion.

3. A unitary beverage container as claimed in claim 2 wherein said hollow chamber member includes a solid connecting wall to said top of said container in said concavity such that said hollow chamber member is in fluid communication with said container volume only through said flexible straw.

4. A unitary beverage container as claimed in claim 3 wherein said lever portion of said mouthpiece is a top wing which extends vertically upwards from a remaining portion of said mouthpiece; and wherein said filling conduit is closed of by a pinch thereof located at a height above said top substantially the same as that of said top wing.

5. A unitary beverage container as claimed in claim 2 wherein said hollow chamber member includes a solid connecting wall to said top portion and to said filling conduit such that said hollow chamber member is in fluid communication with said container volume only through said flexible straw.

6. A unitary beverage container as claimed in claim 5 wherein said lever portion of said mouthpiece is a top wing which extends vertically upwards from a remaining portion of said mouthpiece; and wherein said filling conduit is closed of by a pinch thereof located at a height above said top substantially the same as that of said top wing.

7. A unitary beverage container as claimed in claim 1 wherein said filling conduit includes said distal end of said flexible straw and a spout which extends upwardly from said distal end whereby after filling said filling conduit is pinched off at an intersection of said distal end and said spout.

8. A unitary beverage container as claimed in claim 7 wherein said filling conduit further includes a passage through said concavity between said distal end and said main body whereby after filling said filling conduit is pinched off at said passage.

9. A unitary beverage container as claimed in claim 8 wherein said distal end of said flexible straw includes a mouthpiece having a lever portion such that said lever portion assists a user in a twisting of said mouthpiece to break said hollow bridge.

10. A unitary beverage container as claimed in claim 9 wherein said lever portion of said mouthpiece includes a top wing which extends vertically upwards from a remaining portion of said mouthpiece and from which said spout vertically extends; and wherein said top of said main body includes a concavity adjacent said mouthpiece.

11. A unitary beverage container comprising:

a main body defining a container volume in which a beverage is contained, said main body including a top and a bottom; and a beverage conduit through which said main body is filled and emptied of the beverage, said beverage conduit extending outwardly of said main body from said top of said main body during filling of said main body and subsequently being closed after filling of said main body with the beverage, said beverage conduit including a breakable connection provided below the position where said beverage conduit is closed which is broken when it is desired to consume the beverage in said main body and an inversion facilitating means for accommodating an inversion of a portion of said beverage conduit remaining after said beverage conduit is closed to a position where all of said portion of said beverage conduit is located inside of said main body and for accommodating a return of said portion of said beverage conduit outward of said main body.

12. A unitary beverage container as claimed in claim 11 wherein said top is peripherally flat; wherein said inversion facilitating means of said beverage conduit includes a tapered sleeve having a proximal end adjacent said flat top and a distal end which is smaller in diameter than said proximal end; and wherein said beverage conduit further includes a tube extending from said distal end of said tapered sleeve.

13. A unitary beverage container as claimed in claim 12 wherein said breakable connection is located adjacent said distal end of said frustoconical member and includes a weakened portion of said tube.

14. A unitary beverage container as claimed in claim 13 wherein said tube includes a lever portion extending perpendicular to a longitudinal axis of said tube which is located adjacent said weakened portion such that said lever portion is easily twisted by the user to break said weakened portion.

15. A unitary beverage container as claimed in claim 14 wherein said lever portion is a pair of wings extending in opposite directions.

16. A unitary beverage container as claimed in claim 12 wherein said tube includes a lever portion extending perpendicular to a longitudinal axis of said tube which is located adjacent said breakable connection such that said lever portion is easily twisted by the user to break said breakable connection.

17. A unitary beverage container as claimed in claim 16 wherein said lever portion is a pair of wings extending in opposite directions.

18. A method for filling a beverage container comprising the steps of:

forming a beverage container with a main body defining a container volume and including a top, a bottom, a flexible straw having a proximal end which is fluidly connected with the container volume adjacent the bottom and a distal end having an aperture therein which is located adjacent the top, an attaching means for removably attaching the distal end of the flexible straw to the top of the main body and for closing the aperture of the distal end of the flexible straw with the attaching means including a hollow chamber member attached to the top and a short hollow bridge extending from the distal end of the flexible straw and about the aperture to the hollow chamber member whereby the hollow bridge is broken during removal of the distal end of the flexible straw from the top and thereby the aperture of the flexible straw is uncovered prior to use, and a filling conduit which extends from the top of the main body;

filling the main body with a beverage through the filling conduit; and closing off the filling conduit.

19. A method for filling a beverage container as claimed in claim 18 wherein said forming step includes the step of forming (a) the distal end of the flexible straw as a mouthpiece having a top wing and an opposed bottom wing which wings extend vertically from a remaining portion of the mouthpiece, and (b) the top of the main body with a concavity in which the bottom wing is received, with a top portion adjacent the concavity, and with the filling conduit extending from the top portion; and wherein said closing step includes the step of closing the filling conduit by pinching off all of the filling conduit extending beyond the top wing.

20. A method for filling a beverage container as claimed in claim 18 wherein said forming step includes the step of forming (a) the distal end of the flexible straw as a mouthpiece having a top wing and an opposed bottom wing which wings extend vertically from a remaining portion of the mouthpiece, and (b) the top of the main body with a concavity in which the bottom wing is received, and with the filling conduit extending as a spout from the top wing; and wherein said closing step includes the step of closing the filling conduit by pinching off the filling conduit at the intersection of the spout and the top wing.

21. A method for filling a beverage container as claimed in claim 20 wherein said forming step further includes the step of forming a passage through the concavity between the mouthpiece and the main body; and wherein said closing step further includes the step of pinching off the passage.

22. A method for filling a beverage container comprising the steps of:

forming a beverage container with a main body defining a container volume and including a top, a bottom, a beverage conduit through which the main body is filled and emptied of the beverage with the beverage conduit extending outwardly of the main body from the top of the main body, a breakable connection provided on the beverage conduit which is broken when it is desired to consume the beverage in the main body through the beverage conduit, and an inversion facilitating means for accommodating an inversion of a portion of the beverage conduit remaining after the beverage conduit is closed to a position where all of the portion of the beverage conduit is located inside of the main body and for accommodating a return of the portion of the beverage conduit outward of the main body;

filling the main body with a beverage through the filling conduit;

closing off the filling conduit above the breakable connection to leave the portion of the beverage conduit; and inverting of the portion of the beverage conduit inside of the main body.

23. A method for filling a beverage container as claimed in claim 22 wherein said forming step includes the step of forming the tube as a lever portion extending perpendicular to a longitudinal axis of the tube which is located adjacent the breakable connection such that the lever portion is easily twisted by the user to break the breakable connection.

* * * * *